US006608904B1

(12) United States Patent
Feltström

(10) Patent No.: US 6,608,904 B1
(45) Date of Patent: Aug. 19, 2003

(54) METHOD AND APPARATUS FOR CANCELING INTERFERENCE IN A LOUDSPEAKER COMMUNICATION PATH THROUGH ADAPTIVE DISCRIMINATION

(75) Inventor: Alberto Jimenez Feltström, Löberöd (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/387,740

(22) Filed: Sep. 1, 1999

Related U.S. Application Data

(60) Provisional application No. 60/137,469, filed on Jun. 4, 1999.

(51) Int. Cl.[7] ..... H04R 29/00
(52) U.S. Cl. ..... 381/59; 391/96; 391/71.1
(58) Field of Search ..... 381/71.1, 71.2, 381/71.4, 71.6, 71.7, 71.8, 71.11, 71.12, 74, 94.1, 59, 58, 96

(56) References Cited

U.S. PATENT DOCUMENTS

| | | | | |
|---|---|---|---|---|
| 4,153,815 A | | 5/1979 | Chaplin et al. | |
| 4,238,746 A | | 12/1980 | McCool et al. | |
| 5,325,437 A | * | 6/1994 | Doi | 381/71.8 |
| 5,416,846 A | * | 5/1995 | Tamura | 381/71.8 |
| 5,481,615 A | * | 1/1996 | Eatwell | 381/74 |
| 5,696,819 A | | 12/1997 | Suizu et al. | |
| 5,748,752 A | | 5/1998 | Reames | |
| 5,796,819 A | | 8/1998 | Romesburg | |
| 6,418,228 B1 | * | 7/2002 | Terai | 381/71.8 |

FOREIGN PATENT DOCUMENTS

EP 0 926 839 A2 6/1999

OTHER PUBLICATIONS

Amin M G; "A Frequency–Domain LMS Comb Filter"; IEEE Transactions on Circuits and Systems; vol. 38 No. 12; XP 000291474; Dec. 1, 1991; pp. 1573–1576.

Standard Search Report for RS 103933US Completed Mar. 30, 2000, Apr. 3, 2000, EPO.

* cited by examiner

*Primary Examiner*—Minsun Oh Harvey
(74) *Attorney, Agent, or Firm*—Jenkens & Gilchrist, P.C.

(57) ABSTRACT

According to the present invention, a technique is provided for canceling interference from a first audio signal leading to a loudspeaker. A measuring device measures energy of the loudspeaker to produce a measurement signal. An adaptive unit estimates from the measurement signal a plurality of coefficients. A plurality of multipliers multiply the plurality of coefficients by a plurality of periodic signals so as to produce a Fourier approximation of the interference. A summation unit combines the first audio signal having the interference and the Fourier approximation of the interference to produce a second audio signal having the interference suppressed.

21 Claims, 4 Drawing Sheets

METHOD AND APPARATUS FOR CANCELING INTERFERENCE IN A LOUDSPEAKER COMMUNICATION PATH THROUGH ADAPTIVE DISCRIMINATION

CROSS-REFERENCE TO RELATED APPLICATION

This Application for Patent claims the benefit of priority from, and hereby incorporates by reference the entire disclosure of, now abandoned U.S. Provisional Application for Patent Serial No. 60/137,469, filed Jun. 4, 1999.

FIELD OF THE INVENTION

The present invention relates generally to a technique in digital mobile communications and, more particularly, to a technique for canceling interference in a loudspeaker communication path through adaptive discrimination.

BACKGROUND OF THE INVENTION

In a digital mobile phone, communications are conducted through two possible communication paths. In the first communication path, a microphone of the mobile phone picks up the voice activity of a human user, the subsequent voice activity is converted to an electrical signal, the electrical signal is converted by an analog-to-digital converter into a digitized information stream, the digitized information stream is modulated onto a radio carrier, and the modulated radio carrier is then transmitted over a radio link to a receiver of a base station. In the second communication path, the base station transmits a radio carrier modulated by digital information to the mobile phone, the modulated radio carrier is demodulated by a demodulator of the mobile phone, the demodulated waveform is passed to a digital-to-analog converter, and the analog output of the digital-to-analog converter is directed to a loudspeaker.

A mobile phone implementing the above communication paths comprises many discrete physical components packed into a small area. Consequently, electromagnetic energy of a particular frequency may escape from some of these components into the surrounding environment potentially causing noise interference to the other components of the mobile phone. Of particular concern to a designer of a mobile phone is the microphone and loudspeaker of the mobile phone, both of which are subject to picking up this noise interference from the other components of the mobile phone. This is because the wire connecting the microphone to the analog-to-digital converter and the wire connecting the digital-to-analog converter to the loud speaker are both potentially vulnerable to picking up any electromagnetic energy transmitted from any of the other components. A particular problem is the 217 Hz sending frequency radiated by a Time Division Multiple Access (TDMA) transmitter of a mobile phone operating in accordance with the Global System for Mobile Communications (GSM) standard. This noise interference when heard by human ears resembles the sound of a bumblebee and is thus known as bumblebee noise.

Previously, the problem of noise interference from other components has been solved by careful design of the wires to the loudspeaker and from the microphone. Common trial and error methods of design include trying different wire positions or using more expensive wires. However, this is not an efficient solution to the problem of electromagnetic interference because this solution requires an experimental arrangement of physical components by a skilled designer.

In view of the foregoing, it would be desirable to provide a technique for canceling noise interference (such as bumblebee noise) occurring in a loudspeaker communication path which overcomes the above-described inadequacies and shortcomings. More particularly, it would be desirable to provide a technique for canceling noise interference in a loudspeaker communication path in an efficient and cost effective manner.

SUMMARY OF THE INVENTION

According to the present invention, a technique is provided for canceling interference (e.g., bumblebee noise, noise, periodic interference) from a first audio signal leading to a loudspeaker. A measuring device measures energy of the loudspeaker to produce a measurement signal. An adaptive unit estimates from the measurement signal a plurality of coefficients. A plurality of multipliers multiply the plurality of coefficients by a plurality of periodic signals so as to produce a Fourier approximation of the interference. A summation unit combines the first audio signal having the interference and the Fourier approximation of the interference to produce a second audio signal having the interference suppressed.

In a further aspect of the present invention, the plurality of periodic signals include a plurality of sine waveforms and a plurality of cosine waveforms.

In still a further aspect of the present invention, a signal generator generates the plurality of sine waveforms and the plurality of cosine waveforms.

In yet another aspect of the present invention, the first audio signal includes a speech signal corrupted by the interference.

In another aspect of the present invention, the second audio signal is received by the loudspeaker.

In an aspect of the present invention, the energy is sound energy generated by the loudspeaker, and the measuring device is a microphone receiving a portion of the sound energy.

In another aspect of the present invention, the energy is electrical energy of the second audio signal, and the measuring device receives a portion of the electrical energy.

In one particular aspect of the present invention, the adaptive unit calculates the plurality of coefficients based on a least mean square of the interference and the Fourier approximation of the interference.

In another aspect of the present invention, a filter, coupled to the adaption unit, receives the measurement signal and filters from the measurement signal an error component comprising the interference and the Fourier approximation of the interference.

In yet another aspect of the present invention, the filter includes a phase lock loop centered at 217 kHz.

Another aspect of the present invention includes a transmitter, and the interference is a result of electromagnetic energy generated by the transmitter radiating the electromagnetic energy centered at a predetermined frequency. Typically, the predetermined frequency is approximately 217 Hz.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT

The present invention is employable in any one of many embodiments containing a loudspeaker communication path subject to interference (e.g., bumblebee noise), such as a radio, telephone, or mobile phone. An exemplary embodiment to which the teachings of the present invention are applicable to is that of a mobile phone. Thus, this detailed description is directed to a mobile phone employing the present invention.

Figure 1:
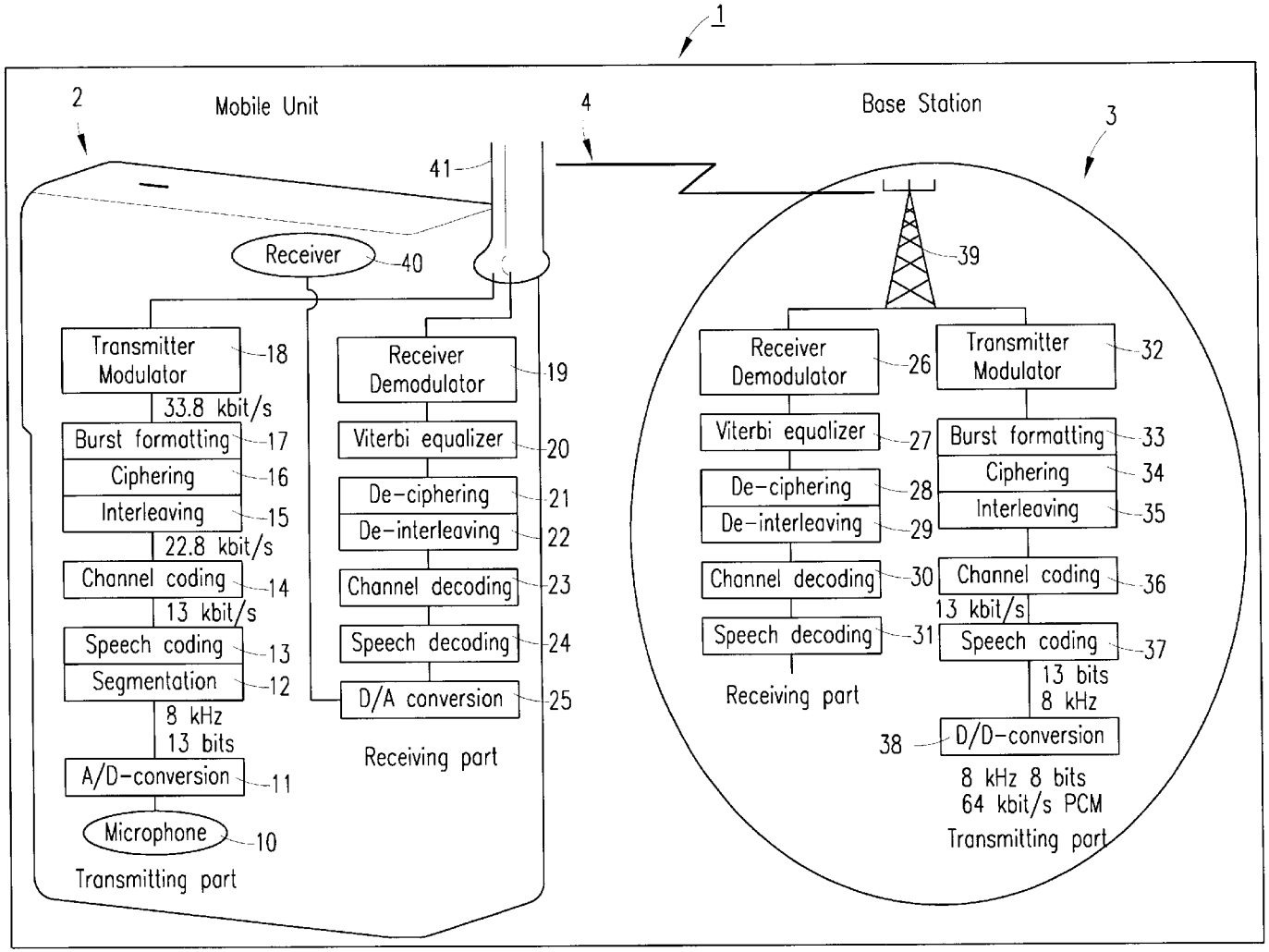
FIG. 1 (PRIOR ART)
FIG. 1 illustrates the communication links of a mobile communications network.

Generally, FIG. 1 illustrates a Global System for Mobile Communications (GSM) 1 comprising a mobile unit 2 and a GSM base station 3. The mobile unit 2 has a transmitting part and a receiving part. The transmitting part of the mobile unit 2 comprises a microphone 10, an analog-to-digital (A/D) converter 11, a segmentation unit 12, a speech coder 13, a channel coder 14, an interleaver 15, a ciphering unit 16, a burst formatting unit 17, and a transmitter modulator 18. The receiving part of the mobile unit 2 comprises a receiver 40 for transmitting sound to a user, a digital-to-analog converter (D/A) 25, a speech decoder 24, a channel decoder 23, a de-interleaver 22, a de-cipherer 21, a Viterbi equalizer 20, and a receiver demodulator 19. Antenna 41 transmits signals for the transmitter part and receives signals for the receiver part of mobile unit 2.

Base station 3 has a transmitting part and receiving part. The receiving part of base station 3 comprises a speech decoder 31, a channel decoder 30, a de-interleaver 29, a deciphering unit 28, a Viterbi equalizer 27, and a receiver demodulator 26. The transmitting part of base station 3 comprises a digital-to-digital (D/D) conversion unit 38 allowing input for data, a speech coder 37 for coding a voice signal, a channel coder 36, an interleaver 35, a ciphering unit 34, a burst formatting unit 33, and a transmitter modulator 32. Antenna 39 is used for both transmission by the transmitter part and reception by the receiving part of base station 3. Signals communicate between the mobile unit 2 and the base station 3 through a channel 4 which is typically an air interface.

Operation of the GSM system 1 precedes as follows for the case where the mobile unit 2 transmits and the base station 3 receives. A speaker speaks into microphone 10 producing an analog voice signal. The analog voice signal is applied to the A/D converter 11 resulting in a digitized speech signal. In GSM, typically 13 bits are used to quantize the signal into 8192 levels and the signal is sampled at an 8 kHz rate, however other configurations are possible. The digitized speech waveform is then fed into the segmentation unit 12 which divides the speech signal into 20 ms segments. The segments are fed into the speech coder 13 for reduction of the bit rate. Typically, speech coders defined for GSM today reduce the bit rate to 13 kbits/s, however, other bit rates are also commonly used. The next steps are channel coding and interleaving. The channel coder 14 adds error correcting and error detecting codes to the speech waveform. The interleaver 15 separates the consecutive bits of a message to protect against burst errors. The ciphering unit 16 adds bits to protect from eavesdropping. The burst formatting unit 17 adds the bits (adds start and stop bits, flags, etc.) to each GSM burst frame. A typical GSM burst frame designed to fit within a Time Division Multiple Access (TDMA) slot may have, along with several formatting bits, 57 encrypted data bits followed by a 26 bit training sequence for the Viterbi equalizer followed by 57 encrypted data bits. The transmitter modulator 18 applies Gaussian Minimum Shift Keying (GMSK) modulation to the bit stream input producing a modulated radio frequency signal at its output suitable for transmission. The modulated radio frequency signal is transmitted via antenna 41 over channel 4 to antenna 39 of base station 3.

The receiver demodulator 26 receives the modulated radio frequency signal and, demodulates the modulated radio frequency signal to a bit stream signal. The Viterbi equalizer 27 creates, based on the 26 bit training sequence, a mathematical model of the transmission channel 4, which in this case is an air interface, and calculates and outputs the most probable transmitted data. In the remaining signal processing chain, the de-ciphering unit 28 performs the inverse transformation performed by the ciphering unit 16, the de-interleaver 29 reverses the interleaving performed by interleaver 15, the channel decoder 30 reverses the channel coding of channel coder 14, and the speech decoder 31 recovers the digital speech stream. Operation of the GSM system 1 precedes in a similar way in the situation where the base station unit 3 transmits and the mobile unit 2 receives.

Figure 2A:
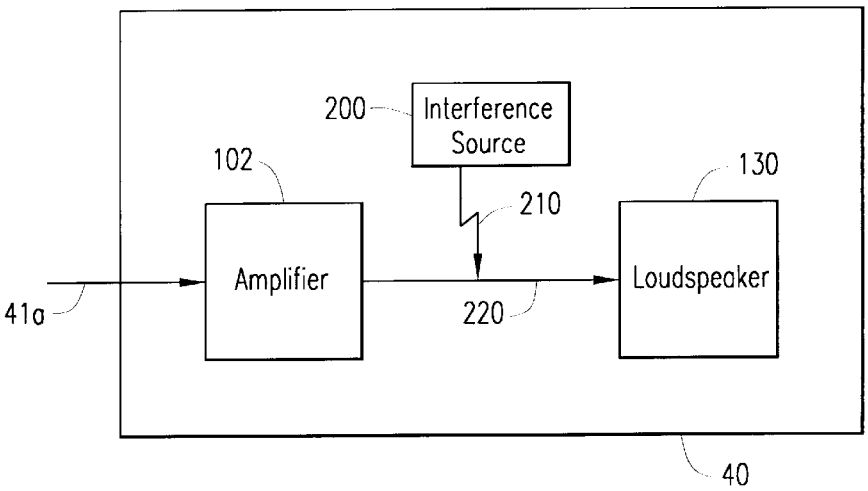
FIG. 2A (PRIOR ART)
FIG. 2A illustrates a receiver of, the mobile phone shown in FIG. 1.

FIG. 2A shows a more detailed view of the prior art receiver 40 of mobile station 2 receiving a signal 41*a* from the D/A converter 25. In the receiver 40, the signal 41*a* is amplified by an audio amplifier 102 producing an amplified audio signal on a communication path 220, which is typically a wire approximately 4" to 5" long. The amplified audio signal on the communication path 220 is received by a loudspeaker 130, which produces sound energy based thereon.

A problem with this prior art receiver is that electromagnetic interference 210 may be introduced to the communication path 220 by an interference source 200. That is, when the communication path 220 is placed close to the interference source 200, which is generating an electromagnetic field typically centered at a predetermined frequency, the communication path 220 may pick up the electromagnetic interference 210. Interference source 200 may potentially be any of the components of the mobile station 2. In the communication path 220, the electromagnetic interference 210 is any extraneous electromagnetic energy which tends to interfere with or produce undesirable disturbance to the reception of a desired signal, which in this case is the voice signal 41*a*. The electromagnetic interference 210 may potentially be generated from any interference source 200 in close physical proximity to the loudspeaker 130, particularly any circuitry generating radio waves. In the mobile phone 2 of the GSM network 1, the electromagnetic interference 210 is typically a periodic radio interference centered approximately at 217 hertz, which is generated from a Time Division Multiple Access (TDMA) unit located in the transmitter module 18 (See FIG. 2). This radio interference when heard by human ears resembles the sound of a bumblebee and is thus known as bumblebee noise.

Figure 2B:
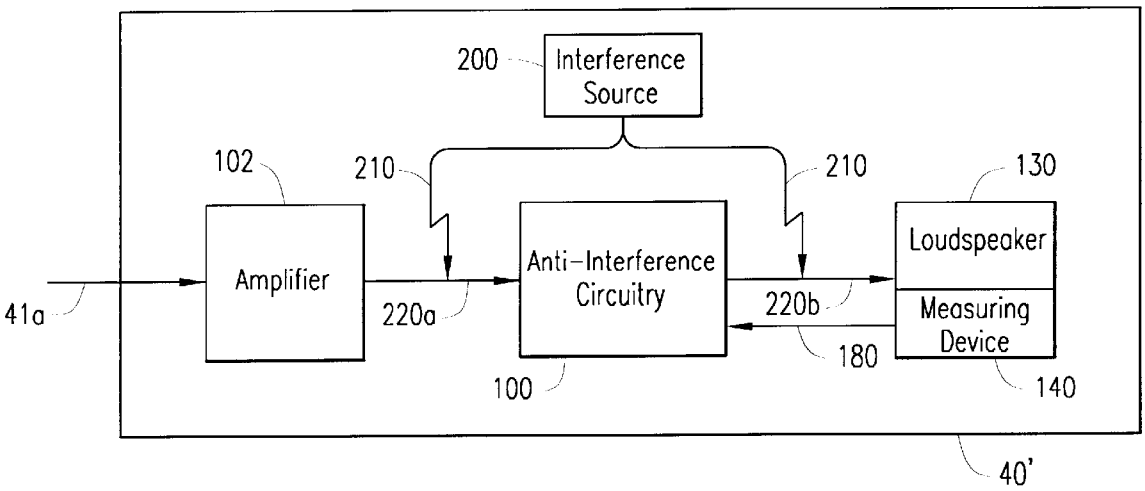
FIG. 2B illustrates a receiver of a mobile phone employing anti-interference circuitry according to the present invention.

FIG. 2B shows a receiver 40' according to the present invention comprising the amplifier 102, anti-interference circuitry 100, the loudspeaker 130, and a measuring device 140. In FIG. 2B, the receiver 40 of mobile station 2 of FIG. 2A is modified to include the anti-interference circuitry 100 inserted in the communication path 220 resulting in a path 220*a* connecting the audio amplifier 102 and the anti-interference circuitry 100 and a path 220*b* connecting the anti-interference circuitry 100 to the loudspeaker 130. The interference source 200 may produce electromagnetic interference 210 in either or both paths 220*a* and 220*b*. In one configuration, the anti-interference circuitry 100 may be connected by a short wire 220*b* to the loudspeaker 102 and by a longer wire 220*a* of 4" to 5" to the amplifier 102. The electromagnetic interference 210 would appear on the longer wire 220*a* whereas the shorter wire 220*b* would not pick up the interference due to the short lead length. Similarly, in an alternate configuration, the anti-interference circuitry 100 could be connected by a short wire 220*a* to the amplifier 102 and by a longer wire 220*b* of 4" to 5" to the loudspeaker 130. In this configuration, the electromagnetic interference 210 would appear on the longer wire 220*b*.

Figure 3:
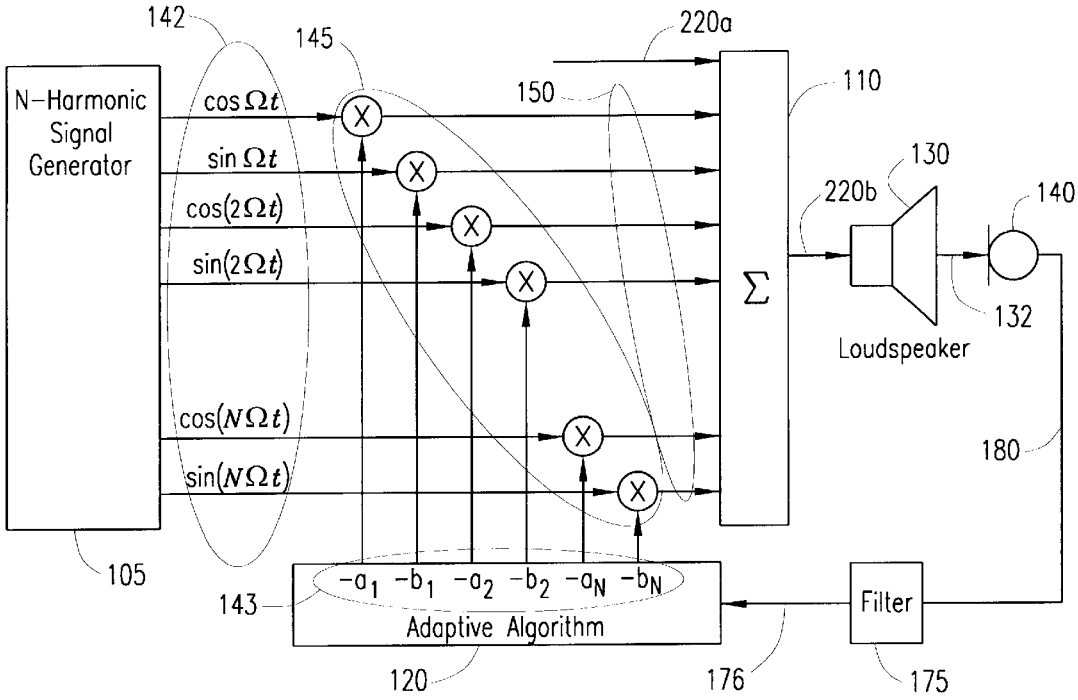
FIG. 3 is a block diagram illustrating circuitry for canceling interference in a loudspeaker communication path in accordance with the present invention.

FIG. 3 shows a more detailed view of the anti-interference circuitry 100 shown in FIG. 2B according to the present invention. Referring to FIG. 3, the anti-interference circuitry 100 is shown comprising an N-harmonic signal generator 105 generating sine waveforms and cosine waveforms 142, a plurality of multipliers 145, a summation unit 110, an adaptive algorithm 120 producing coefficients 143, the loudspeaker 130, the measuring device 140, and a filter 175. In this case, the measuring device 140 is a microphone.

The present invention of FIG. 3 may be implemented using any combination of hardware or software components. For example, the present invention could be implemented with hardware circuitry, or by software instructions executed on a computer. In a preferred embodiment, filter 175 and adaptive algorithm 120 are implemented in software executing on a digital signal processor (DSP) including memory.

The communication path 220*a* (input) carries an audio signal a(t) received from the amplifier 102. The electromagnetic interference 210, represented by interference i(t), may be picked up on the communication paths 220*a* and/or 220*b* to produce a resultant signal, a(t)+i(t).

The present invention works on the principle that any periodic signal can be written as a Fourier series and thus approximated by the first N terms of this series. Denoting the interference in the time domain as $i_N(t)$, the N-Fourier approximation is given by:

$$i_N(t) = a_0 + \sum a_k \cos(k\Omega t) + b_k \sin(k\Omega t)$$

where Ω is the fundamental angle frequency of the interference, and a and b are estimated amplitude coefficients. Since in audio signals there is no DC-level, i.e. $\alpha_0=0$, the anti-interference circuitry of FIG. 3 may be used to generate any anti-interference signal. The degree of the discrimination depends on N, the number of harmonics produced by the signal generator 105, and on the accuracy in the estimation of the coefficients 143, i.e. $\{a_k\}_{k=1}^{N}$ and $\{b_k\}_{k=1}^{N}$.

Due to the superposition-principle, if the anti-interference amplitude of the anti-interference signal $i_N(t)$ is the same as the interference amplitude of the interference i(t) and the phase of the anti-interference signal is of opposite sign to the interference, then the interference i(t) will be discriminated successfully.

The summation unit 110 outputs a signal on path 220*b* that is equal to $a(t)+i(t)-i_N(t)$. This signal is then fed into loudspeaker 130 producing sound energy 132,. The microphone 140, which is placed in close proximately to the loudspeaker 130, receives a portion 180 of the sound energy 132. The filter 175 receives the portion 180 (i.e., a portion of $a(t)+i(t)-i_N(t)$), and passes a correction or error signal 176, which equals to $i(t)-i_N(t)$, to the adaptive algorithm 120.

At this point it should be noted that the microphone 140 is optional. That is, a connection may be made directly between the output of the summation unit 110 and the input of the filter 175.

In the case of GSM, the "bumble-bee" interference frequency is well known to be 217 Hz. The filter 175 may thus contain a digital phase-locked loop (DPLL) with its frequency range centered at 217 Hz which tracks the 217 Hz frequency. However, the frequency range of the DPLL must be sufficiently narrow so that the frequencies of short periodic vowels of the audio waveform a(t) are not passed through.its bandwidth.

The adaptive algorithm unit 120 may use any adaptive algorithm of the signal processing arts to remove the interference from the audio signal. An adaptive algorithm estimates values for the coefficients 143 based on the error component 176, i.e., $i(t)-i_N(t)$. Typical algorithms that may be used in the adaptive algorithm unit 120 are described in S. Haykin, "Adaptive Filter Theory", Prentice Hall 1996. This book describes a great number of algorithms that could be successfully used in the present invention, among them a least mean square (LMS) algorithm.

The plurality of coefficients 143 are multiplied via the multipliers 145 by the sine and cosine waveforms 142 to produce Fourier signals 150. The sum of the Fourier signals 150 is the interference signal $i_N(t)$. The interference signal is subsequently employed as described above.

Figure 4:
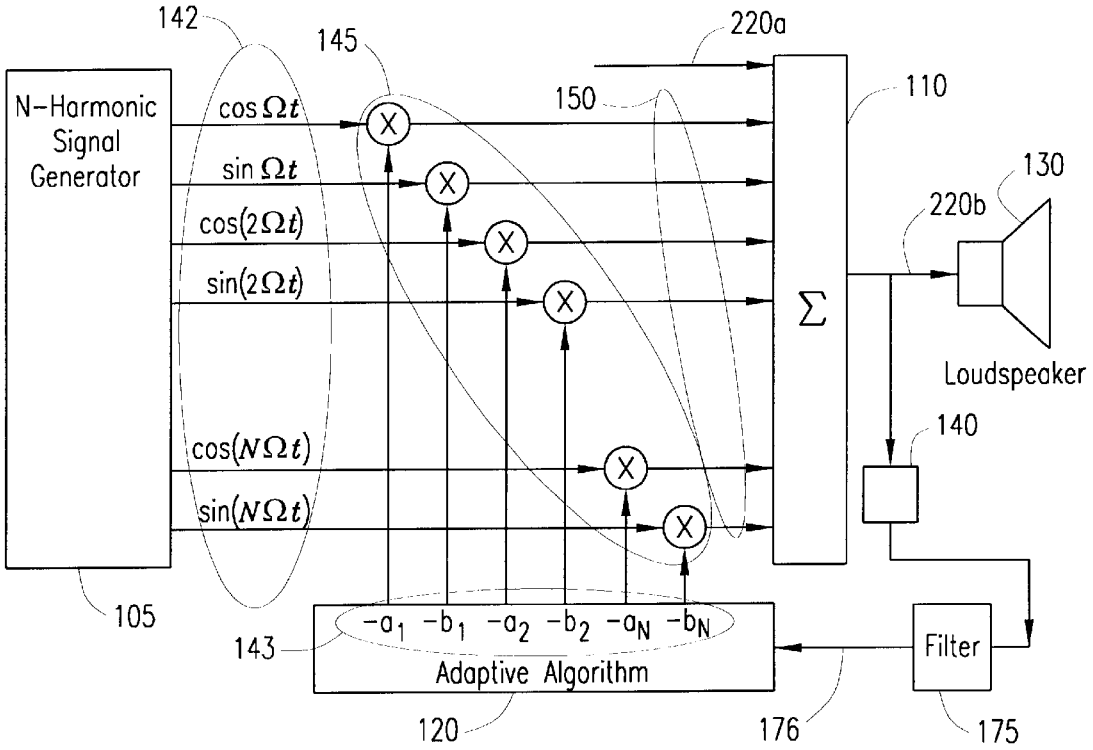
FIG. 4 is a block diagram illustrating circuitry for canceling interference in a loudspeaker communication path in accordance with a second embodiment of the present invention.

FIG. 4 illustrates a second embodiment of the above-described present invention of FIG. 3. In this embodiment, the measuring device 140 is a measuring unit which taps a portion of the electrical signal on path 220*b*. In one embodiment, the measuring unit 140 includes an analog-to-digital converter supplying digital samples to the adaptive algorithm 120.

The above-described present invention adaptively filters out any induced periodic interference in loudspeaker communication paths, and, in particular, "bumble-bee" tones generated in mobile phones. Additionally, the present invention has the advantage that it does not distort an audio signal.

The present invention is not to be limited in scope by the specific embodiments described herein. Indeed, various modifications of the present invention, in addition to those described herein, will be apparent to those of skill in the art from the foregoing description and accompanying drawings. Thus, such modifications are intended to fall within the scope of the appended claims.

What is claimed is:

1. An apparatus for canceling interference from a first audio signal leading to a loudspeaker, comprising:

a measuring device for measuring energy of the loudspeaker to produce a measurement signal;

an adaptive unit for estimating from the measurement signal a plurality of coefficients;

a plurality of multipliers for multiplying the plurality of coefficients by a plurality of periodic signals so as to produce a Fourier approximation of the interference; and a summation unit for combining the first audio signal having the interference and the Fourier approximation of the interference to produce a second audio signal having the interference suppressed.

2. The apparatus of claim 1, wherein the plurality of periodic signals include a plurality of sine waveforms and a plurality of cosine waveforms.

3. The apparatus of claim 2, further comprising:

a signal generator for generating the plurality of sine waveforms and the plurality of cosine waveforms.

4. The apparatus of claim 1, wherein:

the first audio signal includes a speech signal corrupted by the interference.

5. The apparatus of claim 1, wherein:

the second audio signal is received by the loudspeaker.

6. The apparatus of claim 1, wherein:

the energy is sound energy generated by the loudspeaker; and the measuring device is a microphone receiving a portion of the sound energy.

7. The apparatus of claim 1, wherein:

the energy is electrical energy of the second audio signal; and the measuring device receives a portion of the electrical energy.

8. The apparatus of claim 1, wherein:

the adaptive unit calculates the plurality of coefficients based on a least mean square of the interference and the Fourier approximation of the interference.

9. The apparatus of claim 1, further comprising:

a filter, coupled to the adaption unit, for receiving the measurement signal and filtering from the measurement signal an error component comprising the interference and the Fourier approximation of the interference.

10. The apparatus of claim 9, wherein:

the filter includes a phase lock loop centered at 217 kHz.

11. The apparatus of claim 1, further comprising:

a transmitter; and wherein:

the interference is a result of electromagnetic energy generated by the transmitter radiating the electromagnetic energy centered at a predetermined frequency.

12. The apparatus of claim 11, wherein:

the predetermined frequency is approximately 217 Hz.

13. A method for canceling interference from a first audio signal leading to a loudspeaker, comprising:

measuring energy of the loudspeaker to produce a measurement signal;

estimating from the measurement signal a plurality of coefficients;

multiplying the plurality of coefficients by a plurality of periodic signals to produce a Fourier approximation of the interference; and summing the first audio signal having the interference with the Fourier approximation of the interference to produce a second audio signal having the interference suppressed.

14. The method of claim 13, further comprising the step of:

generating the plurality of periodic signals.

15. The method of claim 14, wherein:

the plurality of periodic signals includes a plurality of sine waveforms and a plurality of cosine waveforms.

16. The method of claim 13, further comprising the step of:

directing the second audio signal to the loudspeaker.

17. The method of claim 13, wherein the measuring step comprises:

measuring a portion of the energy from sound generated by the loudspeaker to produce the measurement signal.

18. The method of claim 13, wherein the measuring step comprises:

measuring a portion of the energy of the second audio signal received by the loudspeaker to produce the measurement signal.

19. The method of claim 13, further comprising the step of:

after the measuring step, filtering from the measurement signal an error component comprising the interference and the Fourier approximation of the interference.

20. The method of claim 19, wherein the estimating step further comprises the step of:

estimating from the error component the plurality of coefficients.

21. The method of claim 19, wherein the filtering step includes filtering the measurement signal with a phase lock loop centered at 217 KHz to produce the error component.

* * * * *